US011896094B2

(12) United States Patent
Coe

(10) Patent No.: US 11,896,094 B2
(45) Date of Patent: Feb. 13, 2024

(54) WEARABLE MULTIPURPOSE UMBRELLA

(71) Applicant: Casey P. Coe, Duvall, WA (US)

(72) Inventor: Casey P. Coe, Duvall, WA (US)

( * ) Notice: Subject to any disclaimer, the term of this patent is extended or adjusted under 35 U.S.C. 154(b) by 160 days.

(21) Appl. No.: 17/676,525

(22) Filed: Feb. 21, 2022

(65) Prior Publication Data

US 2022/0265011 A1 Aug. 25, 2022

Related U.S. Application Data

(60) Provisional application No. 63/151,988, filed on Feb. 22, 2021.

(51) Int. Cl.
*A45B 11/02* (2006.01)
*A45B 9/02* (2006.01)
*A45B 7/00* (2006.01)

(52) U.S. Cl.
CPC ..... *A45B 11/02* (2013.01); *A45B 7/00* (2013.01); *A45B 9/02* (2013.01); *A45B 2200/1081* (2013.01)

(58) Field of Classification Search
CPC ..... A45B 11/02; A45B 19/08
See application file for complete search history.

(56) References Cited

U.S. PATENT DOCUMENTS

| | | | | |
|---|---|---|---|---|
| 225,409 | A * | 3/1880 | Mitchell | A45B 11/02 2/171.03 |
| 988,485 | A * | 4/1911 | Mora | A45B 11/02 D3/10 |
| 3,892,251 | A * | 7/1975 | Warfield | A45B 11/02 224/186 |
| 4,148,102 | A | 4/1979 | Ying-Yu | |
| 4,726,247 | A * | 2/1988 | Hormann | E05F 15/686 74/424.6 |
| 5,263,837 | A | 11/1993 | Dompe | |
| 5,887,771 | A * | 3/1999 | Perry | A45B 11/02 224/907 |
| 7,270,619 | B2 * | 9/2007 | Bourc'His | B66F 3/06 474/251 |
| 10,334,920 | B1 | 7/2019 | Chagalamarri | |
| 10,631,602 | B2 | 4/2020 | Ahmed | |
| 10,912,356 | B1 | 2/2021 | Verret | |
| 2008/0116236 | A1 * | 5/2008 | Nickels | A45F 3/08 224/186 |
| 2021/0015222 | A1 * | 1/2021 | Lagandré | A45B 11/04 |

FOREIGN PATENT DOCUMENTS

| | | | | |
|---|---|---|---|---|
| JP | 2000139533 A * | 5/2000 | | |
| JP | 2005040557 A * | 2/2005 | | A45B 11/02 |
| WO | WO-2010035085 A2 * | 4/2010 | | A45B 11/02 |

* cited by examiner

*Primary Examiner* — Noah Chandler Hawk
(74) *Attorney, Agent, or Firm* — Daniel J. Honz; Advent, LLP

(57) ABSTRACT

Systems and methods for transitioning a portable weather canopy between at least two states are described, where a first state provides flexible shaft portions that can be worn on a user's body or wrapped about an object and a second state reversibly couples the flexible shaft portions to provide a rigid shaft to support the canopy. In an aspect, a collapsible, portable weather canopy includes, but is not limited to, a foldable canopy; and a collapsible shaft coupled to the foldable canopy.

20 Claims, 11 Drawing Sheets

WEARABLE MULTIPURPOSE UMBRELLA

CROSS-REFERENCE TO RELATED APPLICATIONS

The present application claims the benefit under 35 U.S.C. § 119(e) of U.S. Provisional Application Ser. No. 63/151,988, filed Feb. 22, 2021, and titled "Wearable multipurpose umbrella." U.S. Provisional Application Ser. No. 63/151,988 is hereby incorporated by reference in its entirety.

BACKGROUND

Umbrellas are a popular method of shielding oneself from the overhead assault of rain or sun. The basic design typically includes a canopy attached to a shaft and supported by a plurality of ribs. A user holds the shaft or a handle attached thereto to support the canopy above their head. Umbrellas can incorporate collapsible designs that collapse or otherwise fold the canopy via a runner that supports stretchers that in turn support the ribs. As the runners travels along the shaft, the stretchers push or pull the ribs to open or close the canopy.

SUMMARY

Systems and methods for transitioning a portable weather canopy between at least two states are described, where a first state provides flexible shaft portions that can be worn on a user's body or wrapped about an object and a second state reversibly couples the flexible shaft portions to provide a rigid shaft to support the canopy. In an aspect, a collapsible, portable weather canopy includes, but is not limited to, a foldable canopy; and a collapsible shaft coupled to the foldable canopy, the collapsible shaft including a shaft having a first end and a second end, the first end configured to couple to the foldable canopy, the second end including a mounting site, a first flexible shaft body extension coupled to the mounting site, the first flexible shaft body extension including a first plurality of links extending from the mounting site, a second flexible shaft body extension coupled to the mounting site, the second flexible shaft body extension including a second plurality of links extending from the mounting site, the second plurality of links configured to releasably couple with the first plurality of links between at least a first shaft configuration and a second shaft configuration, wherein in the first shaft configuration, the first plurality of links and the second plurality of links are coupled together and with the shaft to form a rigid shaft, and in the second shaft configuration, at least a portion of the first plurality of links is separated from the second plurality of links to provide flexible extension portions configured to wrap about a portion of a body of a user or an environmental object to stabilize the foldable canopy relative to the body of the user or the environmental object, and a handle slidably coupled to each of the first flexible shaft body extension and the second flexible shaft body extension, the handle configured to slide toward the shaft to separate the first plurality of links from the second plurality of links and to slide away from the shaft to couple the first plurality of links with the second plurality of links.

In an aspect, a collapsible shaft for a tool includes, but is not limited to, a shaft having a first end and a second end, the first end configured to couple to an implement of the tool, the second end including a mounting site; a first flexible shaft body extension coupled to the mounting site, the first flexible shaft body extension including a first plurality of links extending from the mounting site; and a second flexible shaft body extension coupled to the mounting site, the second flexible shaft body extension including a second plurality of links extending from the mounting site, the second plurality of links configured to releasably couple with the first plurality of links between at least a first shaft configuration and a second shaft configuration, wherein in the first shaft configuration, the first plurality of links and the second plurality of links are coupled together and with the shaft to form a rigid shaft, and in the second shaft configuration, at least a portion of the first plurality of links is separated from the second plurality of links to provide flexible extension portions configured to wrap about a portion of a body of a user or an environmental object to stabilize the first end of the shaft relative to the body of the user or the environmental object.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. In the figures, the use of the same reference numbers in different instances in the description and the figures may indicate similar or identical items.

DETAILED DESCRIPTION

Overview

Figure 1:
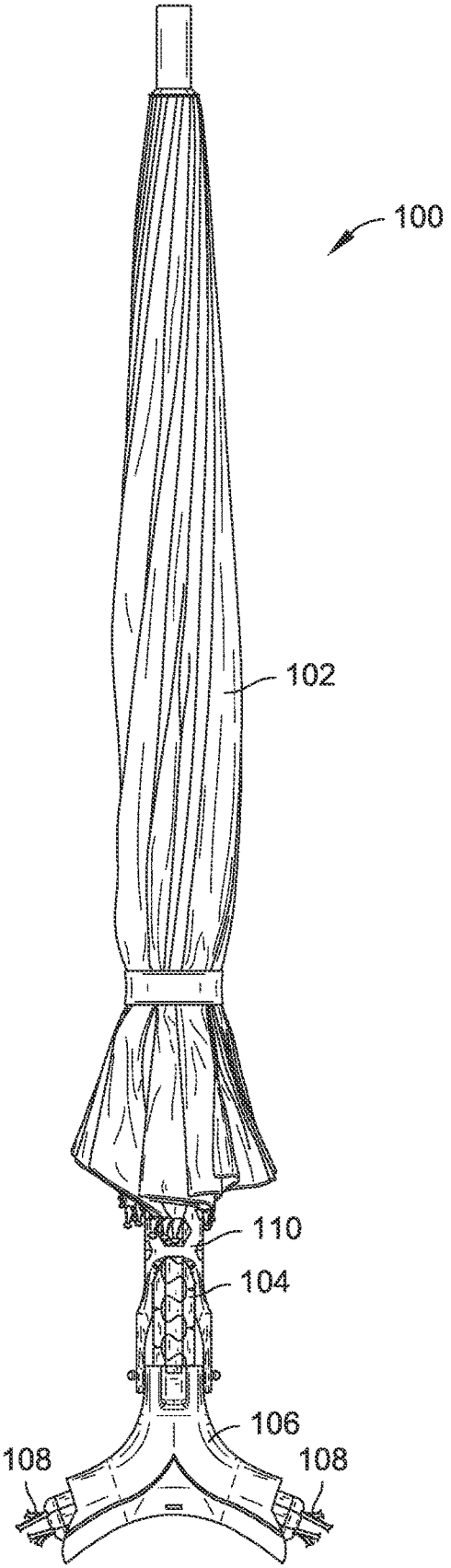
FIG. 1 is a side view of a collapsible, portable weather canopy in a closed configuration with a rigid shaft in accordance with an example embodiment of the present disclosure.

The basic umbrella design has enjoyed a long history of success, however, a major drawback has perennially been the need to hold the unit with one hand. In this way, it deprives the user of full dexterity and drastically limits the situations in which umbrellas are conveniently used. Users have long desired an effective and convenient method with which to gain the benefits of an umbrella without having to hold it with one's hands.

Many attempts at hands-free umbrella systems employ harnesses or holders worn on a user's body, which a basic umbrella is received, but have multiple drawbacks for real world usage of the umbrella. For example, the hands-free umbrella systems can employ a holder mounted to a vest, a backpack, a torso harness, or a belt-based apparatus worn about the waist. Each of these attempts at hands-free umbrella systems are based on a fundamental flaw that require the user to spend most of their time standing straight. As soon as the user bends or crouches for any reason, the canopy is mispositioned and fails to provide proper coverage of the user. These systems are based on a narrow view of the general activity level of users, which results in poor coverage of the user. Moreover, the drawbacks of these systems are compounded by the need for bulky harnesses, obligatory backpacks, or restrictive belts. Furthermore, the time for conversion between stowage and deployment of the canopy is hindered by the need to remove or reposition the holder or for the user to perform some tricky maneuvers behind their back. The unpopularity of such systems is evident by their poor showing in the market.

Other attempts at hands-free umbrella systems employ an umbrella supported on the user's head by a hat or harness worn on the head. While a hat-based umbrella design can have a more centered position to protect a user from weather conditions, the design has large inherent flaws. One such flaw is the difficulty to manage the hat in windy conditions, where the stability of the hat is heavily dependent on how tight the hat grips the user's head. Wearing any hat too tightly can cause headaches, skin damage, or other condition, where a large hat that is being buffeted by the wind can compound these issues. Additionally, hat-based umbrella designs have a further hindrance of not being useful if not being worn on the head. For instance, the hat-based umbrella design does not provide the conveniences of a stand-alone umbrella having a shaft that the user can hold in their hand to support the canopy overhead, which is a traditional umbrella feature that is highly useful.

Accordingly, the present disclosure is directed, at least in part, to systems and methods for a portable weather canopy that includes a shaft that transitions between at least two states, where a first state provides flexible shaft portions that can be worn on a user's body or wrapped about an object and a second state reversibly couples the flexible shaft portions to provide a rigid shaft to support the canopy. The first state of the portable weather canopy can provide a configuration that wraps about a portion of the user's body to maintain the canopy above the user's head while providing a hands-free and stable wearing experience. The second state of the portable weather canopy can provide a configuration that supports the canopy relative to the rigid shaft, which can provide a traditional umbrella experience.

In an aspect, a collapsible, portable weather canopy includes a foldable canopy and a collapsible shaft configured to physically support the foldable canopy relative to a user or an object. The collapsible shaft generally includes at least a shaft portion, a first flexible shaft body extension, a second flexible shaft body extension, and a handle. The shaft can include a first end and a second end, with the first end configured to couple to the foldable canopy, and with the second end including a mounting site. Each of the first flexible shaft body extension and the second flexible shaft body extension can be coupled to the mounting site. For example, the first flexible shaft body extension can include a first plurality of links extending from the mounting site and the second flexible shaft body extension can include a second plurality of links extending from the mounting site, where the second plurality of links can be configured to releasably couple with the first plurality of links. The links can include, for example, a protrusion that extends from a body portion, where the protrusion from one link can interface with a body portion of another link to provide a rigid shaft portion. In aspects, the links of the first plurality of links are coupled together via a cable that extends between the links and the shaft.

The first plurality of links and the second plurality of links can releasably couple between at least a first shaft configuration and a second shaft configuration, where the first shaft configuration couples at least a portion of each of the first plurality of links and the second plurality of links to form a rigid shaft, and where the second shaft configuration at least a portion of the first plurality of links is separated from the second plurality of links to provide flexible extension portions configured to wrap about a portion of a body of a user or an object to stabilize the foldable canopy relative to the body of the user or the object, such as in a hands-free manner.

The handle can be slidably coupled to each of the first flexible shaft body extension and the second flexible shaft body extension to provide separation or coupling therebetween to transition the extensions between the first and second shaft configurations. For example, the handle is generally configured to slide toward the shaft to separate the first plurality of links from the second plurality of links (e.g., to provide the second shaft configuration) and to slide away from the shaft to couple the first plurality of links with the second plurality of links (e.g., to provide the first shaft configuration). The handle can define a shape to contour to a neck or shoulder region of a user, with the first and second flexible shaft body extensions passing through the handle to wrap about the user to stably support the canopy above the user's head when the collapsible shaft adopts the second shaft configuration via positioning of the handle relative to the shaft.

Example Implementations

Referring to FIGS. 1-10, a system 100 for providing a portable weather canopy that includes a collapsible shaft that is convertible between a rigid shaft configuration, configured for hand-held use, and a wrapping configuration, configured to be wrapped about a user's body or an environmental object, is shown in accordance with example embodiments of the present disclosure. The system 100 is shown in FIG. 1 as generally including a foldable canopy 102, a collapsible shaft 104, and a handle 106. The handle 106 is slidably coupled to the collapsible shaft 104 to transition the system 100 between the rigid shaft configuration (e.g., shown in FIGS. 1-3) and the wrapping configuration (e.g., shown in FIG. 9), with a transitional state therebetween shown in FIG. 8. The system 100 is shown including cables 108 that flexibly couple portions of the collapsible shaft 104 together to permit flexible portions to extend from the collapsible shaft 104 to wrap about a portion of a user, an environmental object, or combinations thereof, while supporting the foldable canopy 102 in an open configuration. The system 100 is also shown including a support stand 110 pivotably coupled to the handle 106 that can physically support the system 100 or portions thereof, such as by bracing against an environmental object, an environmental surface, a portion of a user, an object worn by a user, or combinations thereof.

Figure 2:
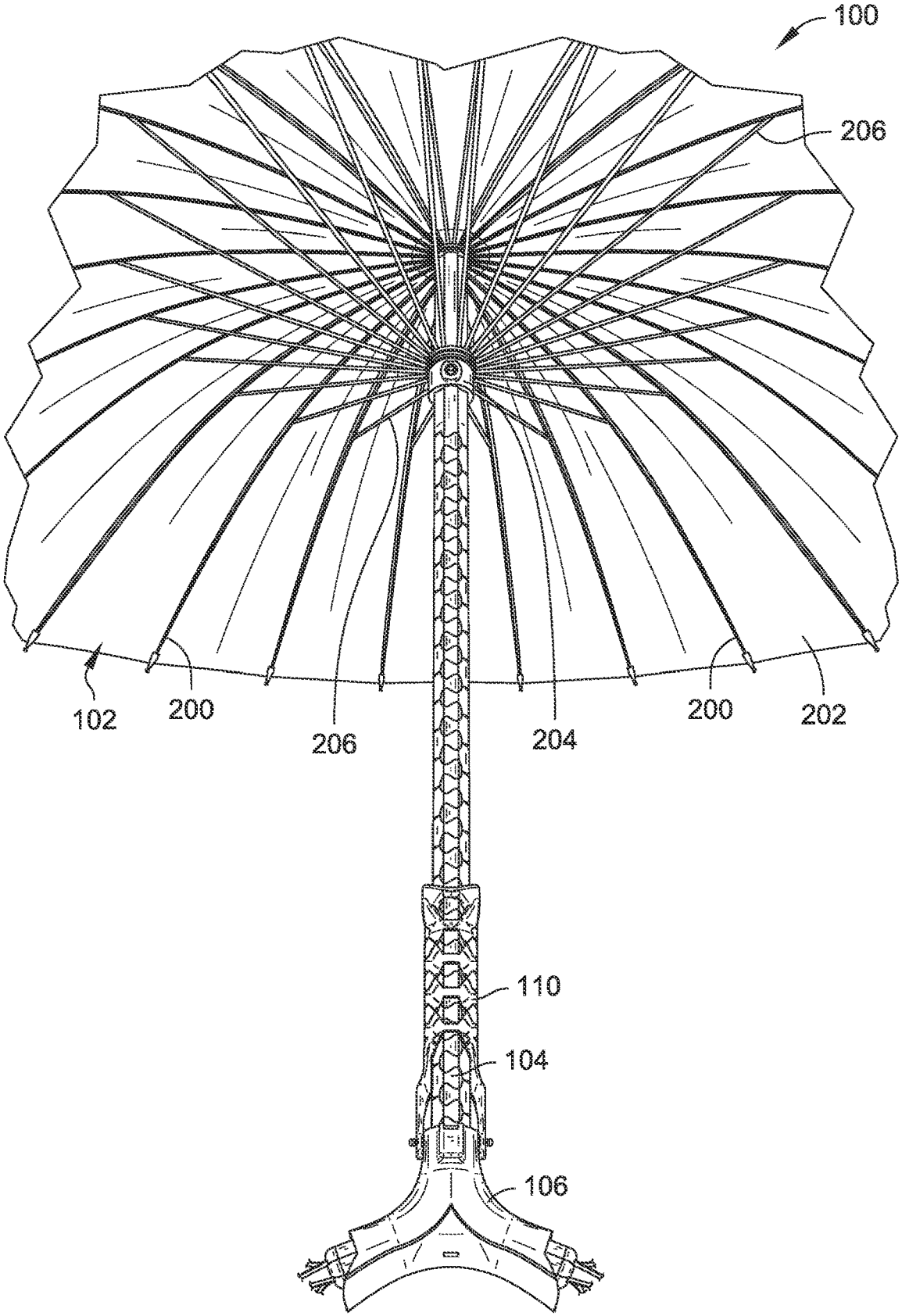
FIG. 2 is an isometric view of the collapsible, portable weather canopy of FIG. 1 in an open configuration with the rigid shaft.

In implementations, an example of which is shown in FIG. 2, the foldable canopy 102 includes a plurality of ribs 200 coupled to a canopy material 202 that forms the outer structure for the foldable canopy 102. The foldable canopy 102 is shown including a runner 204 coupled to the plurality of ribs 200 via a plurality of stretchers 206. The runner 204 defines an aperture through which the collapsible shaft 104 can pass as the runner 204 is slid relative towards or away from the handle 106 to retract or extend the stretchers 206 as the runner 204 slides along the collapsible shaft 104. In implementations, the runner 204 is permitted to slide along the collapsible shaft 104 when the collapsible shaft 104 is in the rigid configuration and is impeded from sliding along the collapsible shaft 104 by a flexible portion of the collapsible shaft 104 when the collapsible shaft 104 is in the wrapping configuration (or transitioning thereto). While the system 100 is shown with the foldable canopy 102 as a foldable umbrella canopy being supported by the collapsible shaft 104, the disclosure is not limited to such a canopy and can include different tool implements supported by the collapsible shaft 104 including, but not limited to, rigid canopies, flexible canopies, rigid umbrellas, flexible umbrellas, rigid parasols, flexible parasols, or other tool implements.

Example components of the collapsible shaft 104 are described with reference to FIGS. 3 through 6. The collapsible shaft 104 is shown including a first flexible shaft body extension 300A, a second flexible shaft body extension 300B, and a shaft section that is configured to coupled to each of the first flexible shaft body extension 300A and the second flexible shaft body extension 300B (e.g., via one or more of the cables 108). The first flexible shaft body extension 300A and the second flexible shaft body extension 300B each include a plurality of links 302 coupled together, such as through cables 108, mechanical hinges, or other mechanical coupling. For example, the first flexible shaft body extension 300A is shown including a first plurality of links 302A and the second flexible shaft body extension 300B is shown including a second plurality of links 302A. The links 302 of each flexible shaft body extension releasably couple with links 302 of another flexible shaft body extension to transition the collapsible shaft 104 between the rigid shaft configuration and the wrapping configuration (e.g., upon lateral movement of the handle 106 along the collapsible shaft 104). In implementations, the links 302 include faceted exterior surfaces to provide an octagonal rigid shaft, however the disclosure is not limited to such shapes of the links 302 and corresponding shaft 104 and can include any other shape for the rigid shaft. While the collapsible shaft 104 is described with reference to two flexible shaft body extensions, the disclosure is not limited to two flexible shaft body extensions and can include more than two flexible shaft body extensions, such as three flexible shaft body extensions, four flexible shaft body extensions, more than four flexible shaft body extensions, and so forth, that releasably couple links of the respective flexible shaft body portions to transition between the rigid shaft configuration and the wrapping configuration.

Figure 3:
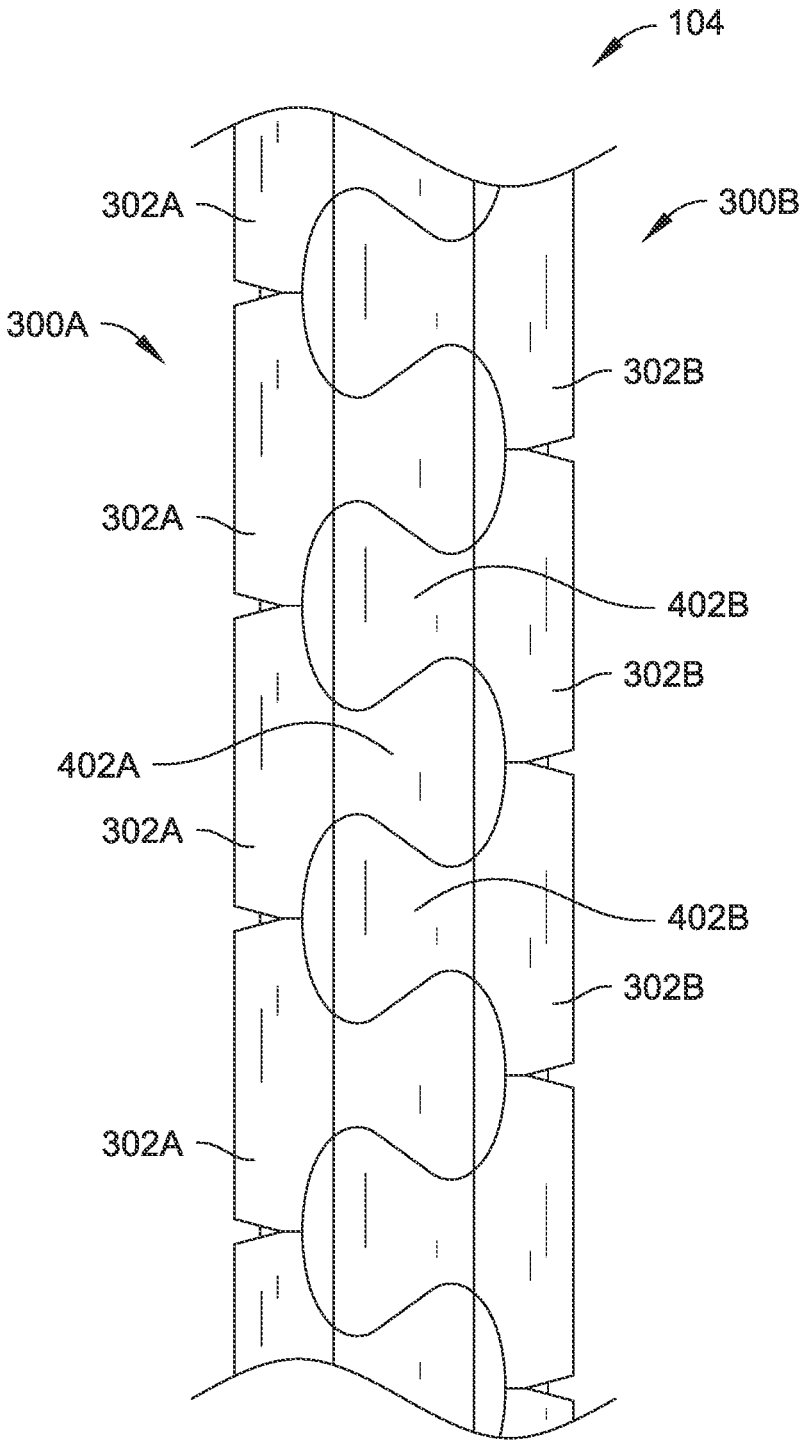
FIG. 3 is a side view of the rigid shaft of FIG. 1.
Figure 4B:
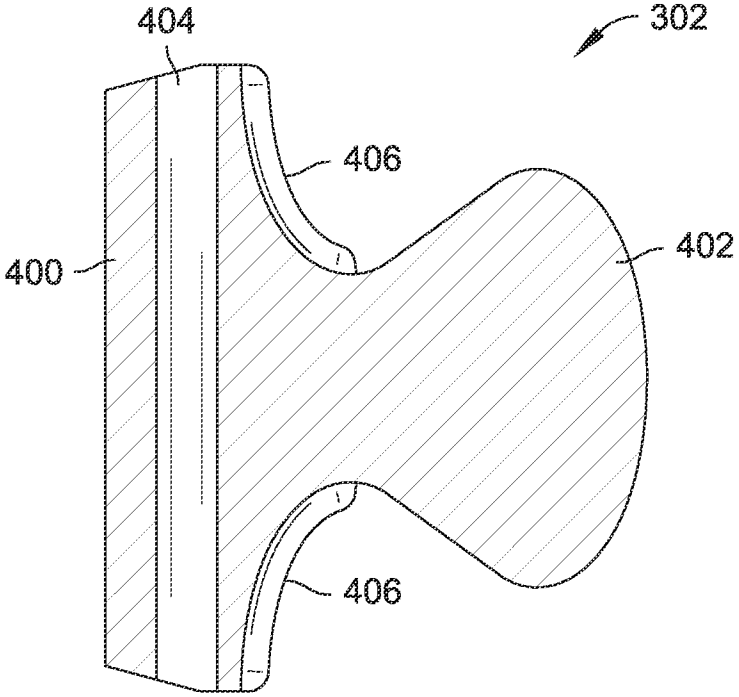
FIG. 4B is a cross sectional side view of the link of FIG. 4A, showing an aperture through which a cable can extend to flexibly couple two or more links in accordance with an example embodiment of the present disclosure.
Figure 4A:
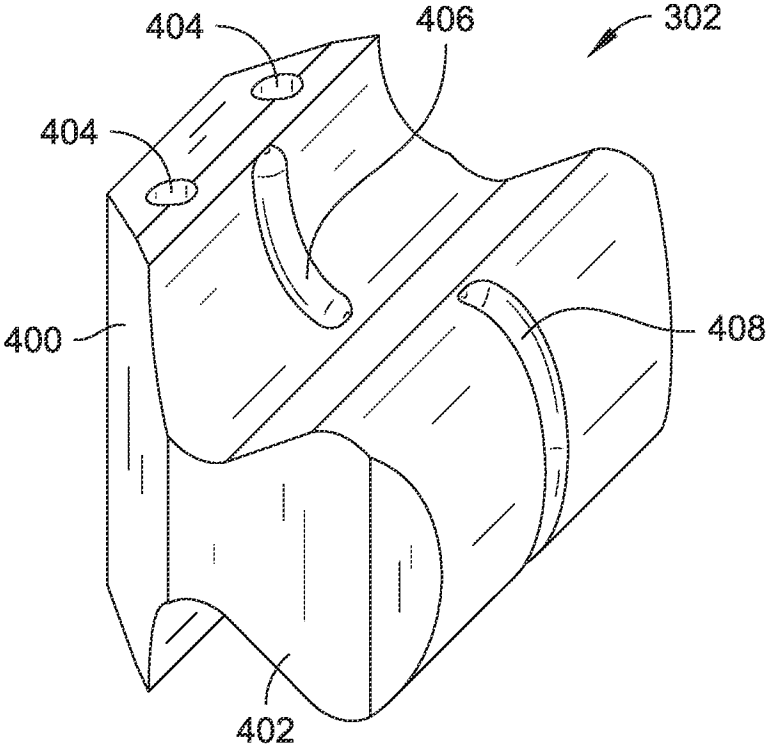
FIG. 4A is an isometric view of a link of a collapsible shaft in accordance with an example embodiment of the present disclosure.
Figure 5:
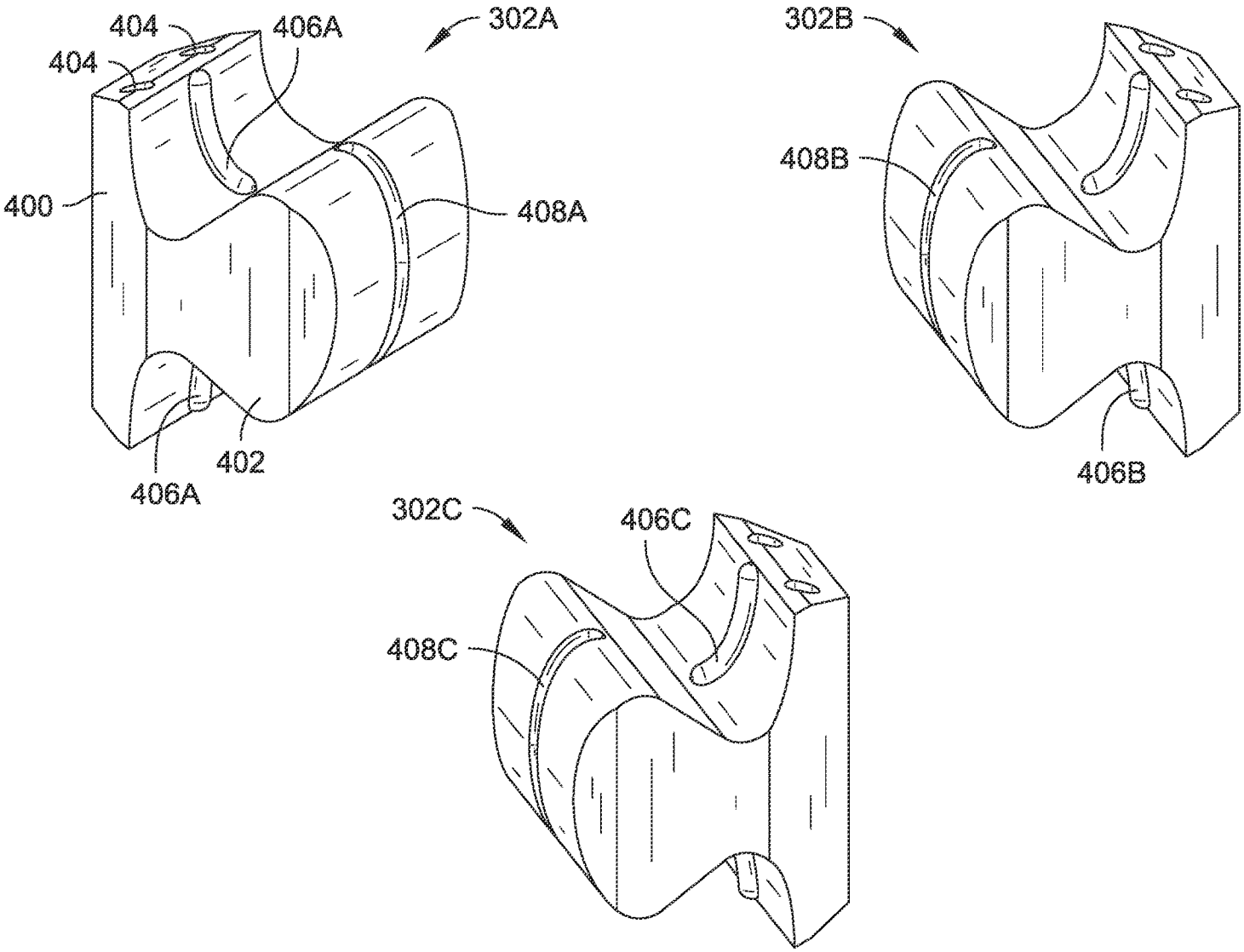
FIG. 5 is a schematic view of a link of a first flexible shaft body extension configured to interface with two links of a second flexible shaft body extension in accordance with an example embodiment of the present disclosure.

Each link 302 is generally shaped such that, when combined with other links to form a flexible shaft body extension and held together via mechanical linkages (e.g., via cables 108), the flexible shaft body extension will resist collapse of the collapsible shaft 104 when combined with interlocking mates from an adjacent flexible shaft body extension. For example, a link 302 is shown in FIG. 4A having a body portion 400 and a protrusion 402 extending from the body portion 400. The protrusion 402 of a link 302 is structured to interface with a protrusion 402 of at least one other link 302 to provide a rigid shaft composed of multiple links 300 that are longitudinally and laterally stabilized through the structural interfaces between links 302. For example, FIG. 4 shows the protrusion 402A of a link 302A of the first flexible shaft body extension 300A interfacing with two protrusions 402B of two different links 302B coupled together forming a portion of the second flexible shaft body extension 300B. In implementations, the protrusion 402 of one link 302 is also configured to interface with at least one body portion 400 of another link 302. For example, the protrusion 402A is shown in FIG. 3 as interfacing with the two protrusions 402B of two different links 302B and with the body portions 400B of the two different links 302B. In implementations, the links 302 of one flexible shaft body extension are coupled together via the cables 108. For example, the link 302 is shown in FIG. 4B with the body portion 400 defining an aperture 404 therethrough to receive the cable 108 through the link 302 for introduction into the body portion 400 of an adjoining link 302. The links 302 can define any number of apertures to receive any number of cables or other mechanical linkages as desired to flexibly couple links of one flexible shaft body extension together. The link 302 is shown with the aperture 404 positioned substantially vertically through the body portion 400, however the aperture 404 could have any other configuration through the link 302 to provide a pathway through which the cable or other mechanical linkage is directed to flexibly couple links of one flexible shaft body extension together.

In implementations, the links 302 can include surface features that facilitate lateral and/or longitudinal stability of the collapsible shaft 104 as the links 302 are interfaced together. For example, referring to FIG. 4A, the link 302 is shown with the body portion 400 defining a ridge 406 extending from the body portion 400 adjacent the protrusion 402, with the link 302 in FIG. 4B is shown with the body portion 400 defining a first ridge 406 on a top portion of the link 302 and defining a second ridge 406 on a bottom portion of the link 302. The link 302 is also shown including a groove 408 on a surface of the protrusion 402 opposite the body portion 400. The ridge 406 of one link 302 is structured to be at least partially received by a groove 408 of another link 302, whereas the groove 408 of one link is structured to at least partially receive a ridge 406 of another link 302. Where a link includes multiple ridges 406, each ridge can interface with a groove 408 of a different link 302 to provide lateral stability between links of different flexible shaft body extensions. For example, referring to FIG. 5, one link 302A of the first flexible shaft body extension 300A and two links (302B, 302C) of the second flexible shaft body extension 300B are shown. The link 302A includes the ridge 406A which is configured to be received in the groove 408B of the link 302B, whereas the ridge 406B of the link 302B is configured to be received in the groove 408A of the link 302A. Similarly, the link 302C includes the ridge 406C which is configured to be received in the groove 408A of the link 302A (e.g., simultaneously with the ridge 406B), whereas the second ridge 406AA of the link 302A (e.g., on the bottom of the link 302A) is configured to be received in the groove 408C of the link 302C. The shapes of the protrusions 402, ridges 406, and grooves 408 provide for a rigid shaft configuration that can be separated through sliding action of the handle 106 that acts to separate the flexible shaft body extensions from each other.

Figure 6:
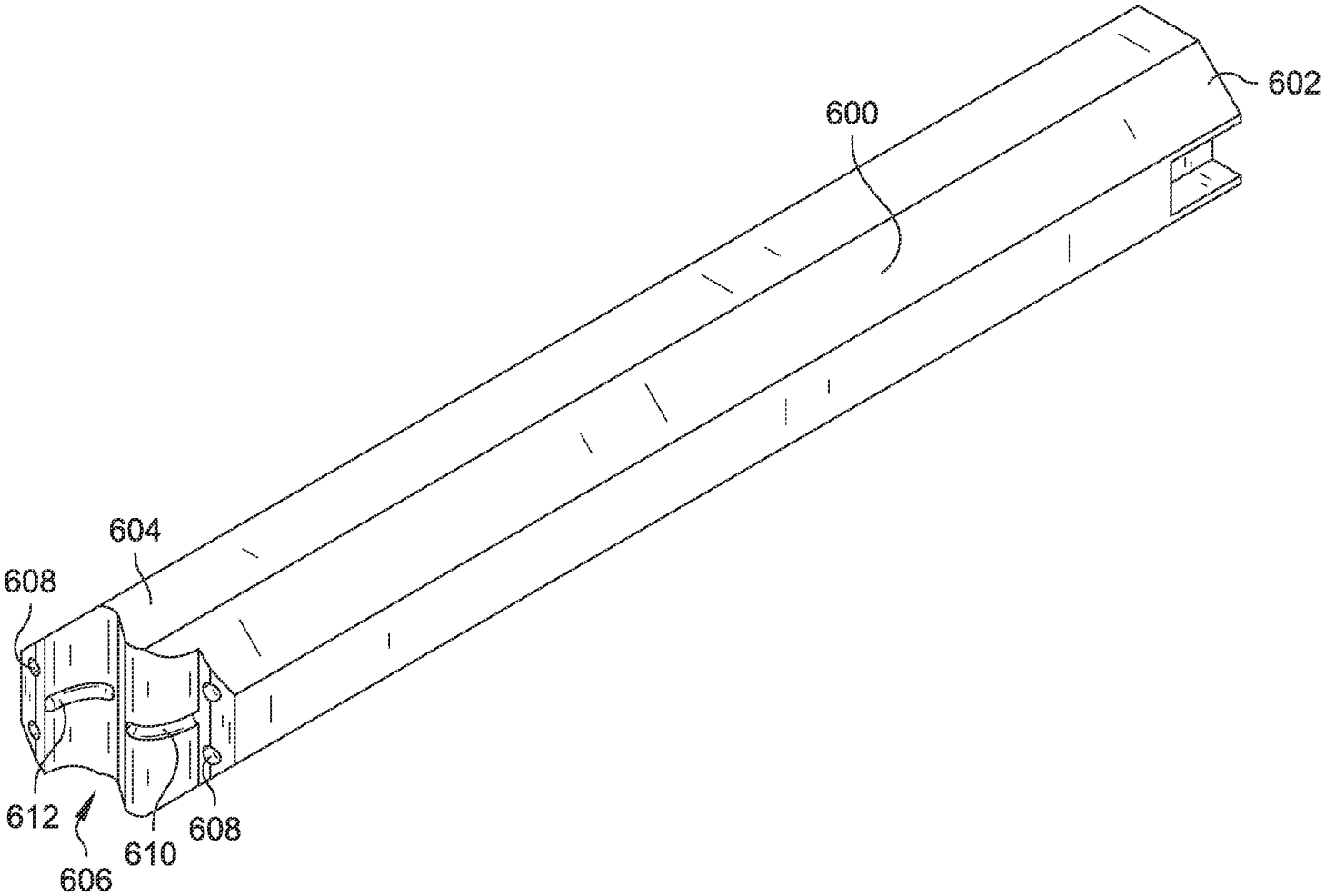
FIG. 6 is an isometric view of a shaft having a first end configured to couple to a canopy and a second end having a mounting site configured to mount a plurality of flexible shaft body extensions in accordance with an example embodiment of the present disclosure.

Referring to FIG. 6, the shaft section of the collapsible shaft 104 is shown including a substantially rigid shaft 600. The shaft 600 includes a first end 602 and a second end 604 opposite the first end 602. The first end 602 is structured to couple with the foldable canopy 102 (e.g., to mount the foldable canopy 102 to the collapsible shaft 104). The second end 604 includes a mounting site 606 that is structured to couple to each of the flexible shaft body extensions (e.g., to the first flexible shaft body extension 300A and the second flexible shaft body extension 300B). For example, the shaft 600 can define one or more shaft apertures 608 extending from the first end 602 to the second end 604 (e.g., opening at the mounting site 606) to receive a cable 108 from adjoining links 302 and into the shaft 600 to secure the first flexible shaft body extension 300A and the second flexible shaft body extension 300B to the shaft 600 at the mounting site 600. In implementations, the mounting site 600 includes contours that match the outline of at least a portion of the protrusion 402 of an adjoining link to provide lateral and longitudinal stability to the connection between the shaft 600 and the flexible shaft body extensions. In implementations, the mounting site 606 includes a groove 610 configured to receive a ridge 406 of an adjoining link 302 and includes a ridge 612 configured to be received into a groove 408 of the adjoining link 302. In implementations, the runner 204 is configured to move in a direction from the first end 602 to the second end 604 and past the mounting site 606 when the collapsible shaft 104 is in the rigid configuration, and is prohibited from moving past the mounting site 606 when the collapsible shaft 104 is in the wrapping configuration.

Figure 7B:
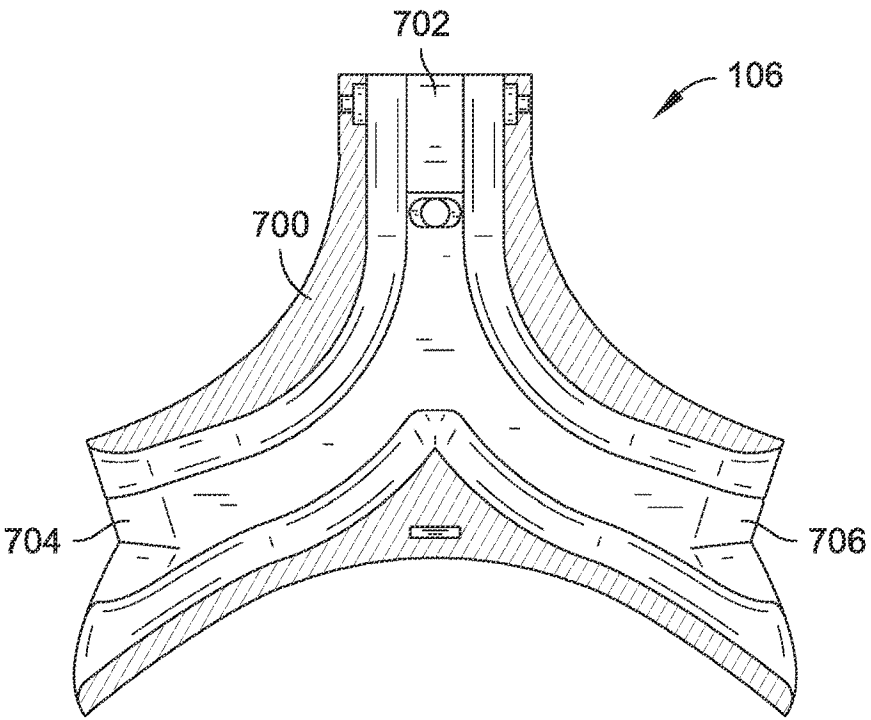
FIG. 7B is a cross sectional side view of the handle of FIG. 7A.
Figure 7A:
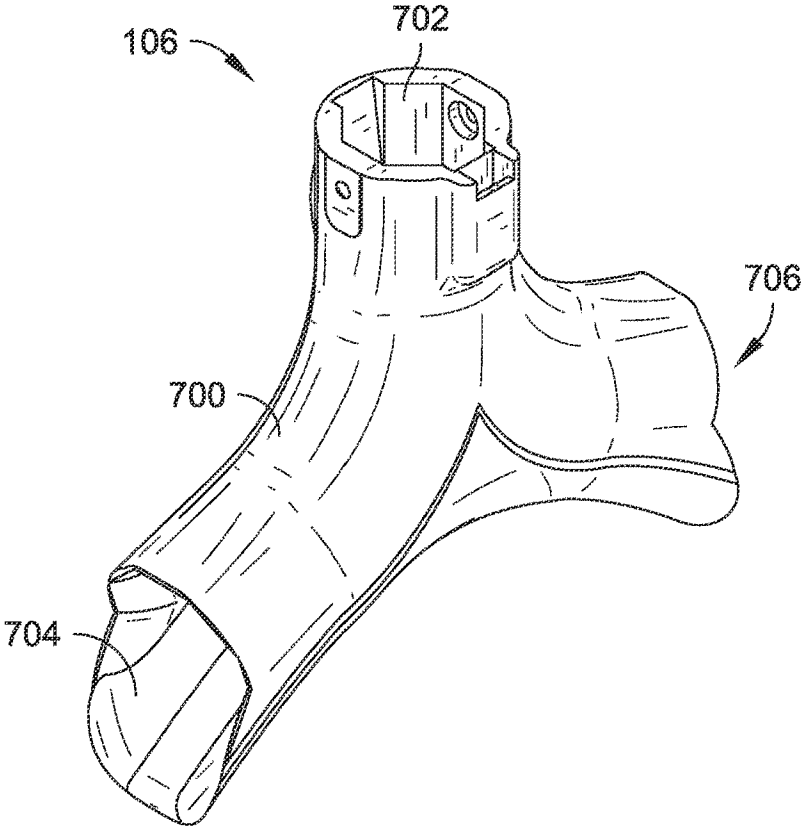
FIG. 7A is an isometric view of a handle configured to slidably couple with a collapsible shaft in accordance with an example embodiment of the present disclosure.
Figure 8:
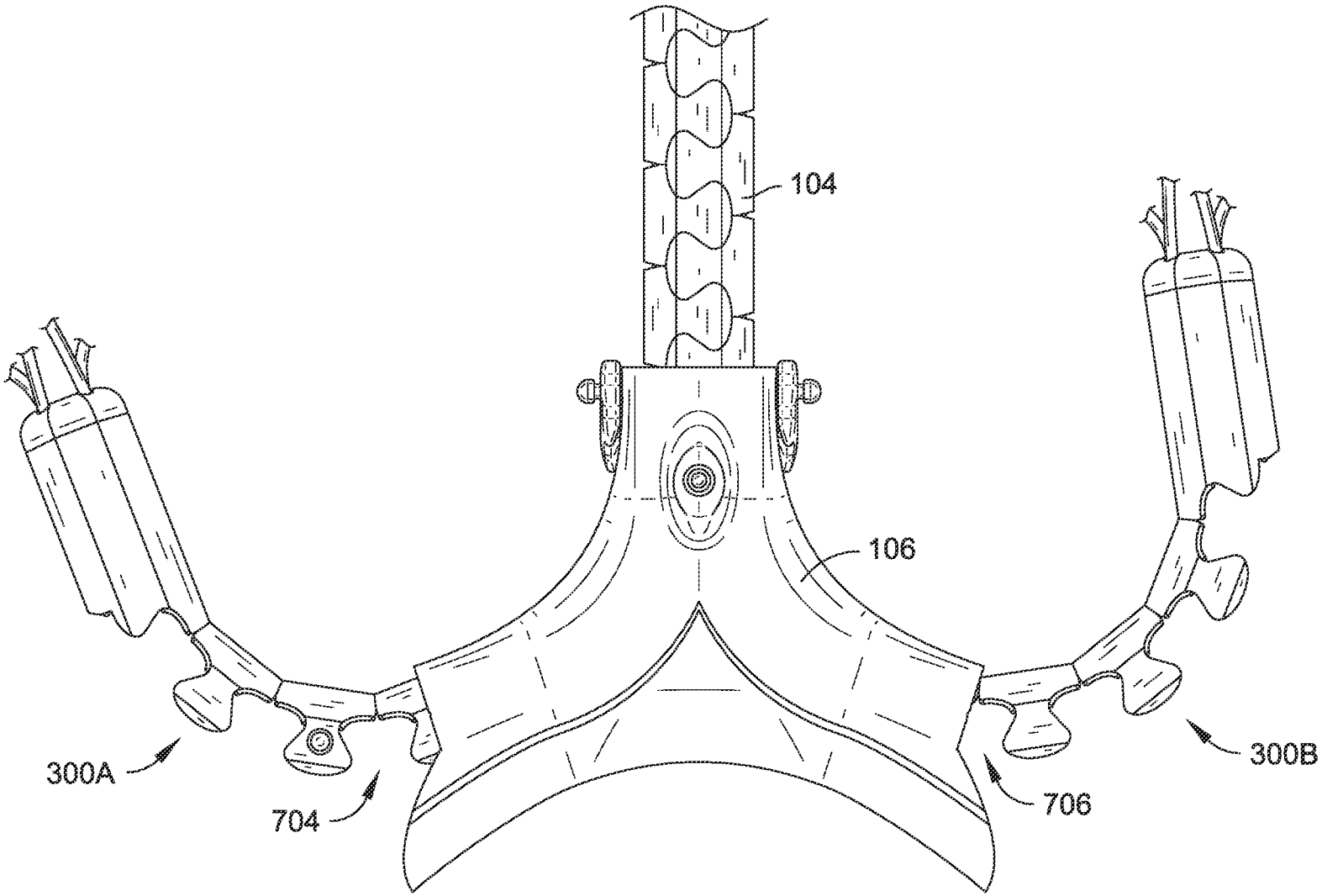
FIG. 8 is a side view of the collapsible, portable weather canopy of FIG. 1, with the handle partially separating two flexible shaft body extensions of the shaft in accordance with an example embodiment of the present disclosure.
Figure 9:
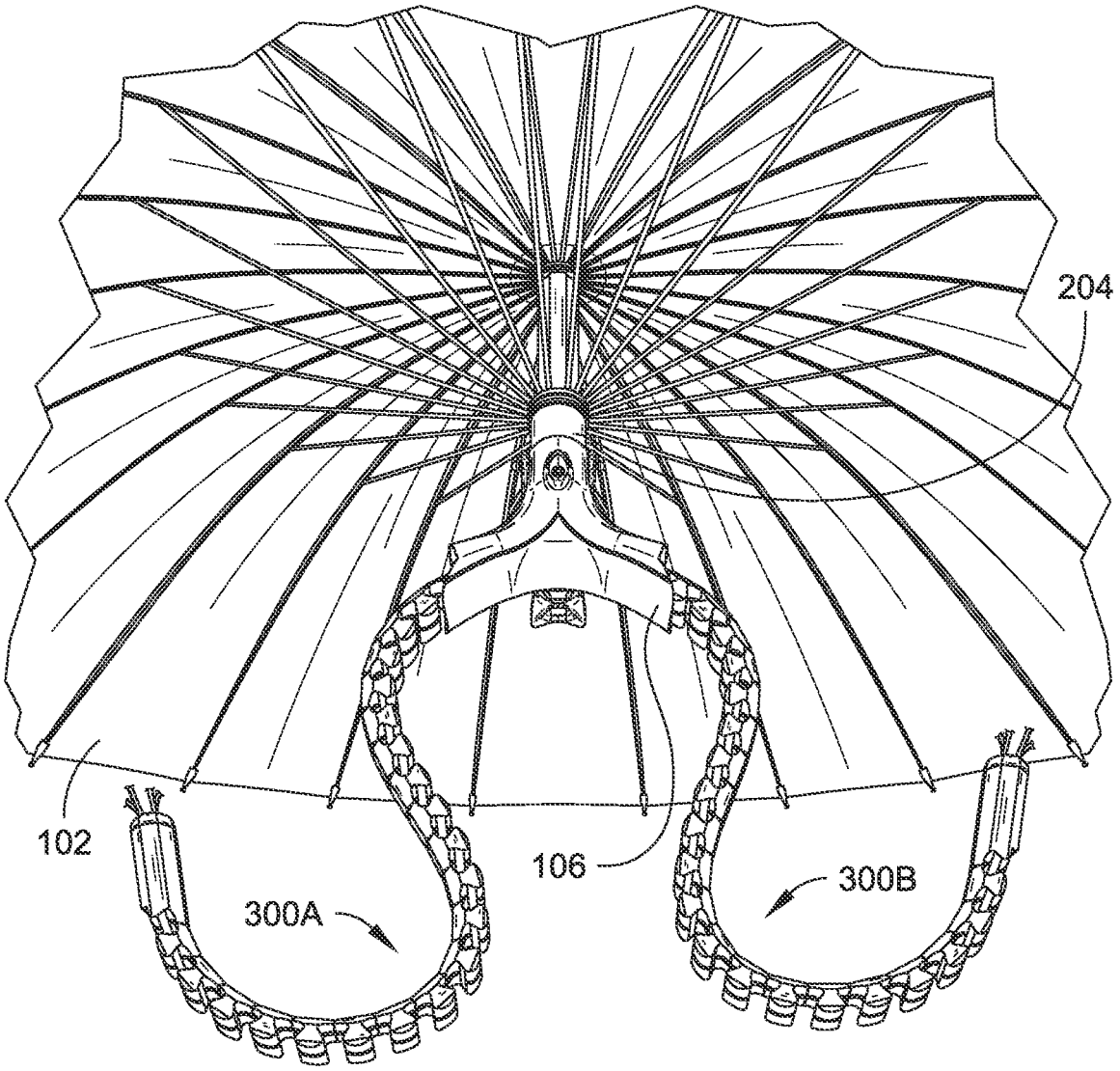
FIG. 9 is an isometric view of the collapsible, portable weather canopy of FIG. 1, in a wearable configuration to provide flexible extension portions configured to wrap about a portion of a body of a user or an environmental object in accordance with an example embodiment of the present disclosure.
Figure 11:
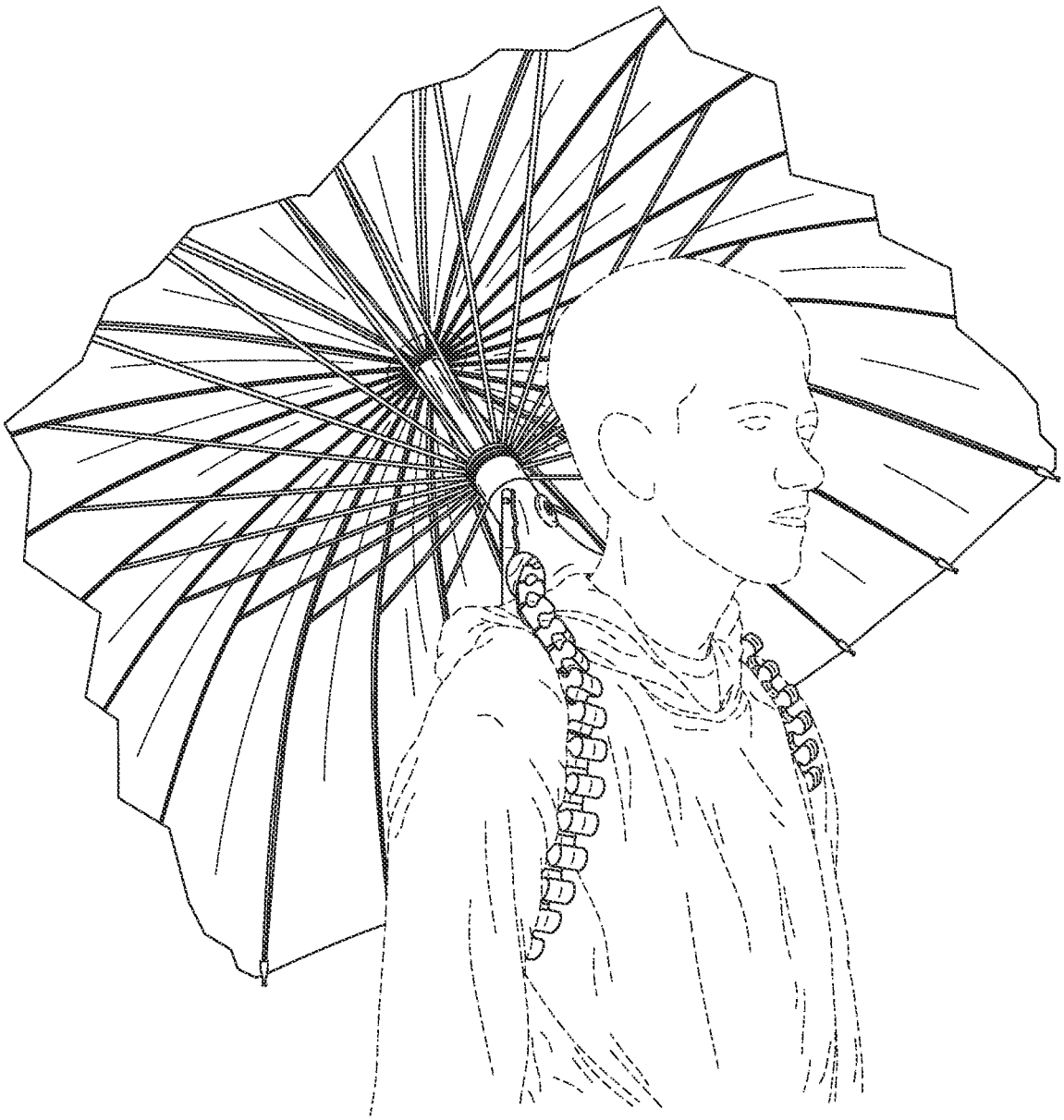
FIG. 11 is a diagrammatic illustration of the collapsible, portable weather canopy of FIG. 1 in a wearable configuration being worn by a user.

Referring to FIGS. 7A and 7B, an example of the handle 106 is shown. The handle 106 generally facilitates the slidable coupling and decoupling of the flexible shaft body extensions by sliding the handle along collapsible shaft 104 (e.g., towards or away from the shaft 600). For example, the handle 106 includes a handle body 700 that defines a shaft aperture 702 structured to receive the collapsible shaft 104 with the first flexible shaft body extension 300A and the second flexible shaft body extension 300B coupled together in the rigid configuration. The handle body 700 also defines a first extension aperture 704 and a second extension aperture 706, where the first extension aperture 704 is configured to receive the first flexible shaft body extension 300A following separation of the links 302A from the links 302B of the second flexible shaft body extension 300B and where the second extension aperture 706 is configured to receive the second flexible shaft body extension 300B following separation of the links 302B from the links 302A of the first flexible shaft body extension 300A. Other apertures can be defined by the handle body 700 if additional flexible shaft body extensions are included in the system 100. An example separation process of the handle 700 separating links 302A of the first flexible shaft body extension 300A from links 302B of the second flexible shaft body extension 300B is shown in FIG. 8, whereas FIG. 9 shows the system 100 in the wrapping configuration, with the handle 700 positioned adjacent the shaft 600 having fully separated the links 302A of the first flexible shaft body extension 300A from links 302B of the second flexible shaft body extension 300B. With the flexible shaft body extensions separated, the respective extensions can be wrapped about portions of a user's body (e.g., as shown in FIG. 11), an environmental object, or the like, to support the foldable canopy 102 above the user, above the environmental object, or the like. In implementations, the system 100 includes straps or other coupling devices (e.g., attached to the handle 106, to the cables 108, or to another structure of the system 100) to provide additional stability during wrapping of the flexible shaft body extensions.

Figure 10:
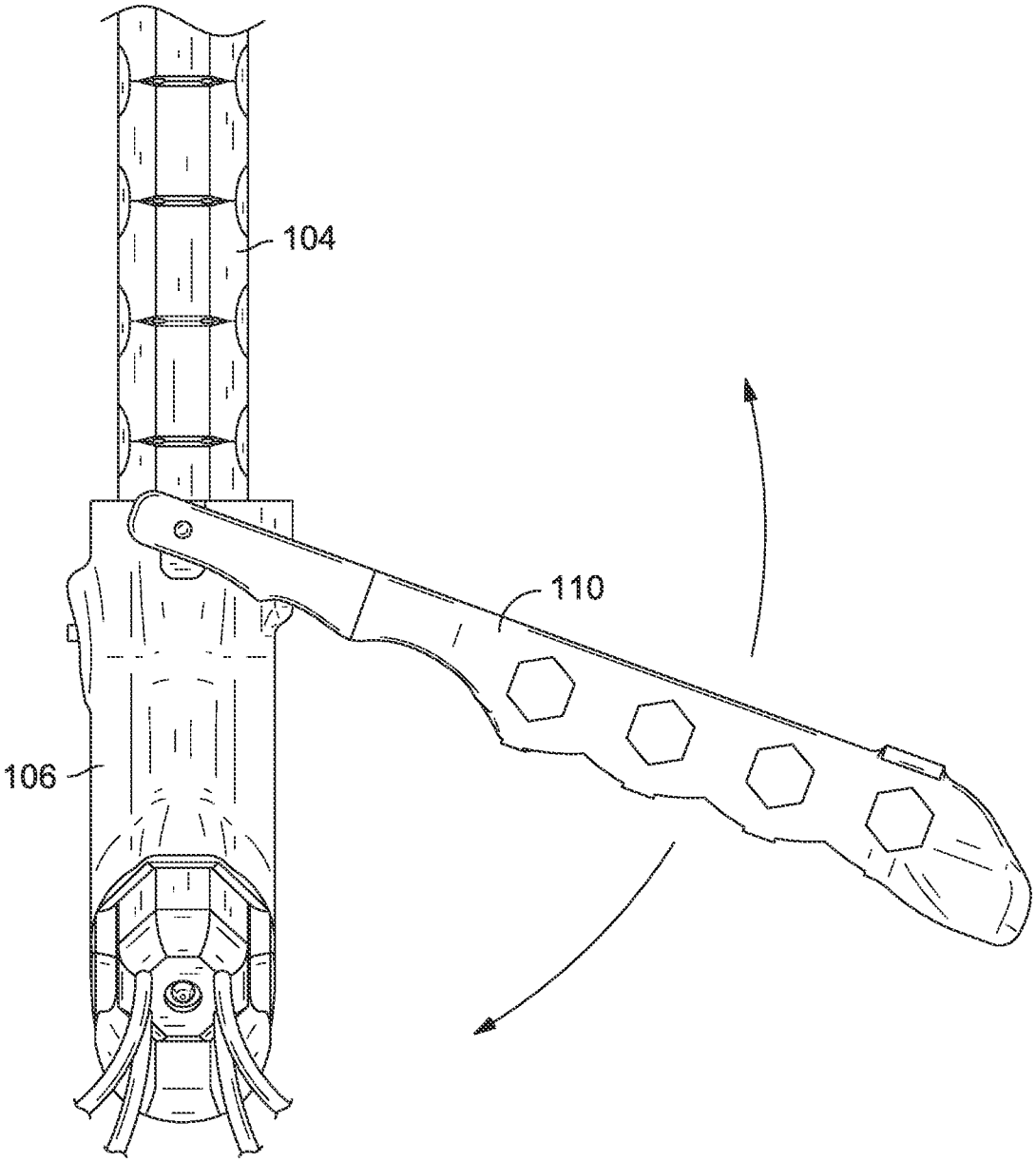
FIG. 10 is a side view of the collapsible shaft with a support stand pivotably coupled to the handle in accordance with an example embodiment of the present disclosure.

Referring to FIG. 10, the support stand 110 is shown pivotably coupled to the handle 106, where the support stand 110 can rotate being a position coupled to the rigid shaft (e.g., shown in FIG. 1) to a position that can physically support the system 100 or portions thereof, by bracing against an environmental object, an environmental surface, a portion of a user, an object worn by a user, or combinations thereof (e.g., as shown in FIG. 10). For instance, the support stand 110 can resist a backwards leaning motion of the foldable canopy 102 when the system 100 is secured to the user or the like.

CONCLUSION

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

The invention claimed is:

1. A collapsible, portable weather canopy, comprising:

a foldable canopy; and a collapsible shaft coupled to the foldable canopy, the collapsible shaft including a shaft having a first end and a second end, the first end configured to couple to the foldable canopy, the second end including a mounting site, a first flexible shaft body extension coupled to the mounting site, the first flexible shaft body extension including a first plurality of links extending from the mounting site, a second flexible shaft body extension coupled to the mounting site, the second flexible shaft body extension including a second plurality of links extending from the mounting site, the second plurality of links configured to releasably couple with the first plurality of links between at least a first shaft configuration and a second shaft configuration, wherein in the first shaft configuration, the first plurality of links and the second plurality of links are coupled together and with the shaft to form a rigid shaft, and in the second shaft configuration, at least a portion of the first plurality of links is separated from the second plurality of links to provide flexible extension portions configured to wrap about a portion of a body of a user or an environmental object to stabilize the foldable canopy relative to the body of the user or the environmental object, and a handle slidably coupled to each of the first flexible shaft body extension and the second flexible shaft body extension, the handle configured to slide toward the shaft to separate the first plurality of links from the second plurality of links and to slide away from the shaft to couple the first plurality of links with the second plurality of links.

2. The collapsible, portable weather canopy of claim 1, further including a runner coupled to the canopy via one or more stretchers, the runner configured to slide about the shaft and to slide beyond the mounting site when the collapsible shaft is in the first shaft configuration, wherein the runner is impeded from sliding beyond the mounting site by at least one of the first flexible shaft body extension or the second flexible shaft body extension when the collapsible shaft is in the second shaft configuration.

3. The collapsible, portable weather canopy of claim 1, wherein the first plurality of links includes a first link having a first body portion and a first protrusion extending from the first body portion, wherein the second plurality of links includes a second link having a second body portion and a second protrusion extending from the second body portion, wherein the first protrusion is configured to interface with the second protrusion when the collapsible shaft is in the first shaft configuration, and wherein the first protrusion is further configured to interface with the second body portion when the collapsible shaft is in the first shaft configuration.

4. The collapsible, portable weather canopy of claim 1, wherein the first plurality of links includes a cable that couples individual links to provide the flexible extension portion, and wherein the first body portion defines a substantially vertical aperture through which the cable is positioned.

5. The collapsible, portable weather canopy of claim 1, further comprising a support stand pivotably coupled to one of the foldable canopy or the handle.

6. The collapsible, portable weather canopy of claim 1, wherein the handle includes a handle body that defines a shaft aperture, a first extension aperture, and a second extension aperture, wherein the shaft aperture is configured to receive the rigid shaft, wherein the first extension aperture is configured to receive the first flexible shaft body extension following separation of the first plurality of links from the second plurality of links, and the second extension aperture is configured to receive the second flexible shaft body extension following separation of the second plurality of links from the first plurality of links.

7. A collapsible shaft for a tool, comprising:

a shaft having a first end and a second end, the first end configured to couple to an implement of the tool, the second end including a mounting site;

a first flexible shaft body extension coupled to the mounting site, the first flexible shaft body extension including a first plurality of links extending from the mounting site; and a second flexible shaft body extension coupled to the mounting site, the second flexible shaft body extension including a second plurality of links extending from the mounting site, the second plurality of links configured to releasably couple with the first plurality of links between at least a first shaft configuration and a second shaft configuration, wherein in the first shaft configuration, the first plurality of links and the second plurality of links are coupled together and with the shaft to form a rigid shaft, and in the second shaft configuration, at least a portion of the first plurality of links is separated from the second plurality of links to provide flexible extension portions configured to wrap about a portion of a body of a user or an environmental object to stabilize the first end of the shaft relative to the body of the user or the environmental object.

8. The collapsible shaft of claim 7, wherein the implement includes an umbrella canopy.

9. The collapsible shaft of claim 8, further including a runner coupled to the umbrella canopy via one or more stretchers, the runner configured to slide about the shaft and to slide beyond the mounting site when the collapsible shaft is in the first shaft configuration.

10. The collapsible shaft of claim 9, wherein the runner is impeded from sliding beyond the mounting site by at least one of the first flexible shaft body extension or the second flexible shaft body extension when the collapsible shaft is in the second shaft configuration.

11. The collapsible shaft of claim 7, wherein the first plurality of links includes a first link having a first body portion and a first protrusion extending from the first body portion, wherein the second plurality of links includes a second link having a second body portion and a second protrusion extending from the second body portion, and wherein the first protrusion is configured to interface with the second protrusion when the collapsible shaft is in the first shaft configuration.

12. The collapsible shaft of claim 11, wherein the first protrusion is further configured to interface with the second body portion when the collapsible shaft is in the first shaft configuration.

13. The collapsible shaft of claim 11, wherein the first body portion includes a first ridge extending from the first body portion adjacent the first protrusion, and wherein the first body portion defines a first groove on a surface of the first protrusion opposite the first body portion.

14. The collapsible shaft of claim 13, wherein the second body portion includes a second ridge extending from the second body portion adjacent the second protrusion configured to be received into the first groove, and wherein the second body portion defines a second groove on a surface of the second protrusion opposite the second body portion configured to receive the first ridge when the collapsible shaft is in the first shaft configuration.

15. The collapsible shaft of claim 11, wherein the first plurality of links includes a cable that couples individual links to provide the flexible extension portion.

16. The collapsible shaft of claim 15, wherein the first body portion defines a substantially vertical aperture through which the cable is positioned.

17. The collapsible shaft of claim 16, wherein the shaft defines an aperture extending from the first end to the second end to receive the cable to couple the first flexible shaft body extension to the mounting site.

18. The collapsible shaft of claim 7, further comprising a handle slidably coupled to each of the first flexible shaft body extension and the second flexible shaft body extension, the handle configured to slide toward the shaft to separate the first plurality of links from the second plurality of links and to slide away from the shaft to couple the first plurality of links with the second plurality of links.

19. The collapsible shaft of claim 18, wherein the handle includes a handle body that defines a shaft aperture, a first extension aperture, and a second extension aperture, wherein the shaft aperture is configured to receive the rigid shaft, wherein the first extension aperture is configured to receive the first flexible shaft body extension following separation of the first plurality of links from the second plurality of links, and the second extension aperture is configured to receive the second flexible shaft body extension following separation of the second plurality of links from the first plurality of links.

20. The collapsible shaft of claim 19, wherein the first extension aperture is offset from a longitudinal axis of the rigid shaft.

* * * * *